US011252994B2

(12) United States Patent
Zappoli et al.

(10) Patent No.: US 11,252,994 B2
(45) Date of Patent: Feb. 22, 2022

(54) APPARATUS AND METHOD FOR THE PRODUCTION OF SHEET LIKE TOBACCO MATERIAL

(71) Applicant: PHILIP MORRIS PRODUCTS S.A., Neuchatel (CH)

(72) Inventors: Stefano Zappoli, Bologna (IT); Ilario Lodi, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 146 days.

(21) Appl. No.: 16/604,691

(22) PCT Filed: Apr. 12, 2018

(86) PCT No.: PCT/EP2018/059447
§ 371 (c)(1),
(2) Date: Oct. 11, 2019

(87) PCT Pub. No.: WO2018/189325
PCT Pub. Date: Oct. 18, 2018

(65) Prior Publication Data

US 2020/0337361 A1 Oct. 29, 2020

(30) Foreign Application Priority Data

Apr. 12, 2017 (EP) ..... 17166374

(51) Int. Cl.
*A24D 3/02* (2006.01)
*A24C 5/01* (2020.01)
(Continued)

(52) U.S. Cl.
CPC ..... *A24D 3/0204* (2013.01); *A24B 3/14* (2013.01); *A24C 5/01* (2020.01); *A24C 5/18* (2013.01); *A24C 5/28* (2013.01)

(58) Field of Classification Search
CPC ..... A24C 5/18; A24C 5/01; A24B 3/14
See application file for complete search history.

(56) References Cited

U.S. PATENT DOCUMENTS 3,646,855 A 3/1972 Muller

FOREIGN PATENT DOCUMENTS

| | | |
|---|---|---|
| GB | 1 060 736 | 3/1967 |
| GB | 1 264 894 | 2/1972 |
| WO | WO 2015/028644 | 3/2015 |

OTHER PUBLICATIONS

PCT Search Report and Written Opinion for PCT/EP2018/059447 dated Jun. 1, 2018 (12 pages).

*Primary Examiner* — Eric Yaary
*Assistant Examiner* — Jennifer A Kessie
(74) *Attorney, Agent, or Firm* — Mueting Raasch Group

(57) ABSTRACT

The invention relates to an apparatus (10) for crimping a sheet (40) of material, the apparatus comprising a first and second facing crimping roller (11, 21) defining a first and second rotation axis, respectively, the first roller including: •a first plurality of circumferential ridges (16), each ridge defining a ridge amplitude; •wherein each of said first plurality of ridges is interrupted along its circumferential extension forming an interruption gap where for a given interruption angle an amplitude of the ridge differs from the ridge amplitude in the remaining circumferential extension of the ridge; •wherein said plurality of interruption gaps forms an interruption band defining a direction of extension, said direction of extension being angled with respect to a direction defined by the first rotation axis of an angle comprised between about 2° to about 25°. The invention also relates to a method for crimping a sheet of material as well as a crimped sheet of material and a rod made of a crimped sheet.

3 Claims, 4 Drawing Sheets

(51) Int. Cl.

| | |
|---|---|
| ***A24B 3/14*** | (2006.01) |
| ***A24C 5/18*** | (2006.01) |
| ***A24C 5/28*** | (2006.01) |

APPARATUS AND METHOD FOR THE PRODUCTION OF SHEET LIKE TOBACCO MATERIAL

This application is a U.S. National Stage Application of International Application No. PCT/EP2018/059447 filed Apr. 12, 2018, which was published in English on Oct. 18, 2018 as International Publication No. WO 2018/189325 A1. International Application No. PCT/EP2018/059447 claims priority to European Application No. 17166374.3 filed Apr. 12, 2017.

This invention relates to an apparatus and a process for producing sheet-like tobacco material. In particular, the invention relates to an apparatus and a process for producing sheet-like tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. A process for making such homogenized tobacco is for example disclosed in European Patent EP0565360.

In a typical manufacturing process of aerosol generating articles at least one component comprises a material, usually in a sheet or foil format, that goes through a crimping process. The crimped material is then compressed into a rod which is cut into parts, usually tubular. These rods are components of the aerosol generating articles.

While the crimping process is helpful for compressing and folding the sheet of material into rods that will fit into the aerosol generating articles, the crimping process also influences, inter alia, the amount of air contact, the Resistance To Draw (RTD), and others, and, hence, it is directly experienced by the users of the smoking articles.

As a consequence, applying an adequate crimping pressure is an important parameter of the crimping process. While a too low crimping pressure decreases the positive effects of the crimping, a too high pressure could damage the sheet of material, decrease its tensile strength which increases tearing occurrence and can even shred it.

The crimping process commonly uses two rotating cylindrical rollers between which the sheet of material is pressed. These rollers have matching textured ridge-and-trough patterns on their outside surfaces that crimp the sheet.

There is therefore a need for an apparatus and a method for preparing a sheet of material having an improved consistency in the final product.

According to a first aspect, the invention relates to an apparatus for crimping a sheet of material, the apparatus comprising a first and second facing crimping roller defining a first and second rotation axis, respectively, the first roller including: a first plurality of circumferential ridges, each ridge defining a ridge amplitude; wherein each of said first plurality of ridges is interrupted along its circumferential extension forming an interruption gap where for a given interruption angle an amplitude of the ridge differs from the ridge amplitude in the remaining circumferential extension of the ridge and wherein said plurality of interruption gaps forms an interruption band defining a direction of extension, said direction of extension being angled with respect to a direction defined by the first rotation axis of an angle comprised between about 2° to about 25°.

According to the invention, a crimped sheet is formed, on which surface patterns are created having a specific distribution. Those surface patterns include "standard" classical crimper roller patterns combined with portions, such as areas on the crimped sheet, which are "differently crimped", for example, portions having no crimping or less crimping than in the "standard" pattern areas. This combination of different crimping patters may allow to maintain good overall tensile strength of the sheet while also preventing "fly out" effect by making sure to create, on the sheets, bands of differently crimped surface than the rest of the sheet, such as uncrimped or less crimped surface. The uncrimped or less crimped surface holds or anchors together all the other crimped parts of the sheet. The crimping patterns form bands on the sheet which form a given angle. This angle is selected within the claimed range in order to obtain the optimal resistance to draw.

The above combination of portions having different crimping is particularly advantageous when sheets of homogenized tobacco material are processed.

As used herein, the term "sheet" denotes a laminar element having a width and length substantially greater than the thickness thereof.

As used herein, the term "crimped" denotes a sheet or web with a plurality of corrugations.

As used herein, the term "corrugations" denotes a plurality of substantially parallel ridges formed from alternating peaks and troughs joined by corrugation flanks. This includes, but is not limited to, corrugations having a square wave profile, sinusoidal wave profile, triangular profile, sawtooth profile, or any combination thereof.

As used herein, the term "crimp corrugations" refers to the corrugations on a crimped sheet or web.

As used herein, the term "substantially interleave" denotes that the corrugations of the first and second rollers at least partially mesh. This includes arrangements in which the corrugations of one or both of the rollers are symmetrical or asymmetrical. The corrugations of the rollers may be substantially aligned, or at least partially offset. The peak of one or more corrugations of the first or second rollers may interleave with the trough of a single corrugation of the other of the first and second rollers. Preferably, the corrugations of the first and second rollers interleave such that substantially all of the corrugation troughs of one of the first and second rollers each receive a single corrugation peak of the other of the first and second rollers.

As used herein, the term "longitudinal direction" refers to a direction extending along, or parallel to, the length of a sheet or web.

As used herein, the term "pitch value" refers to the lateral distance between the troughs at either side of the peak of a particular corrugation.

As used herein, the term "rod" denotes a generally cylindrical element of substantially circular or oval cross-section.

As used herein, the terms "axial" or "axially" refer to a direction extending along, or parallel to, the cylindrical axis of a rod.

As used herein, the terms "gathered" or "gathering" denote that a web or sheet is convoluted, or otherwise compressed or constricted substantially transversely to the cylindrical axis of the rod.

As used herein, the term "amplitude value" refers to the height of a corrugation from its peak to the deepest point of the deepest directly adjacent trough.

As used herein, the term "homogenised tobacco material" denotes material formed by agglomerating particulate tobacco.

A homogenised tobacco material may be in the form of a sheet. The homogenised tobacco material may have an aerosol-former content of greater than 5 percent on a dry weight basis. The homogenised tobacco material may alternatively have an aerosol former content of between about 5 percent and about 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and nonaqueous solvents and combinations thereof.

The homogenized tobacco material may form part or the entirety of an aerosol-forming substrate, An aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper is considered to be the aerosol-forming substrate.

As used herein, aerosol forming article is any article that generates an inhalable aerosol when an aerosol forming substrate is heated. The term includes articles that comprise an aerosol forming substrate that is heated by and external heat source, such as an electric heating element. An aerosol forming article may be a non-combustible aerosol forming article, which is an article that releases volatile compounds without the combustion of the aerosol-forming substrate. An aerosol forming article may be a heated aerosol forming article, which is an aerosol forming article comprising an aerosol forming substrate that is intended to be heated rather than combusted in order to release volatile compounds that can form an aerosol. The term includes articles that comprise an aerosol forming substrate and an integral heat source, for example a combustible heat source.

An aerosol-generating article may be a heated aerosol-generating article, which is an aerosol-generating article comprising an aerosol-forming substrate that is intended to be heated rather than combusted in order to release volatile compounds that can form an aerosol. A heated aerosol-generating article may comprise an on-board heating means forming part of the aerosol-generating article, or may be configured to interact with an external heater forming part of a separate aerosol-generating device.

An aerosol-generating article may resemble a combustible smoking article, such as a cigarette.

An aerosol-generating article may comprise tobacco. An aerosol-generating article may be disposable. An aerosol-generating article may alternatively be partially-reusable and comprise a replenishable or replaceable aerosol-forming substrate.

Preferably, the aerosol-forming substrate is formed from or comprises a homogenised tobacco material having an aerosol former content of greater than 5 percent on a dry weight basis and water. For example the homogenised tobacco material may have an aerosol former content of between about 5 percent and about 30 percent by weight on a dry weight basis. An aerosol generated from such aerosol-forming substrates may be perceived by a user to have a particularly high temperature and the use of a high surface area, low resistance to draw aerosol-cooling element may reduce the perceived temperature of the aerosol to an acceptable level for the user.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be received in the aerosol-generating device such that the length of the aerosol-forming substrate is substantially parallel to the airflow direction in the aerosol-generating device. The aerosol-cooling element may be substantially elongate.

The aerosol-generating article may have a total length between approximately 30 mm and approximately 100 mm. The aerosol-generating article may have an external diameter between approximately 5 mm and approximately 12 mm.

The aerosol-generating article may comprise a filter or mouthpiece. The filter may be located at the downstream end of the aerosol-generating article. The filter may be a cellulose acetate filter plug. The filter is approximately 7 mm in length in one embodiment, but may have a length of between approximately 5 mm and approximately 10 mm. The aerosol-generating article may comprise a spacer element located downstream of the aerosol-forming substrate.

The elements of the aerosol-generating article are preferably assembled by means of a suitable wrapper, for example a cigarette paper. A cigarette paper may be any suitable material for wrapping components of an aerosol-generating article in the form of a rod. Preferably, the cigarette paper holds and aligns the component elements of the aerosol-generating article when the article is assembled and hold them in position within the rod. Suitable materials are well known in the art.

The apparatus of the invention is used to crimp a sheet of material. For example, such a sheet could be a sheet of an aerosol forming substrate. Preferably, the sheet is formed in a material including a plant. More preferably, the sheet includes a plant material containing alkaloids. Even more preferably, the sheet includes tobacco, for example in the form of homogenized tobacco material. In order to crimp the sheet, the apparatus includes a first and a second roller forming a pair. The first and second roller can rotate around a first and a second rotation axis. Between the two rollers, the sheet of material is inserted in order to crimp the sheet, that is, in order to form corrugations on the same.

The corrugations are formed by the apparatus of the invention by means of ridges formed in at least one of the rollers of the pair, for example on the first roller.

Ridges are realized on an external surface of the first roller and extend circumferentially around the surface itself. The ridge therefore surrounds the cylinder forming a loop. The loop may be circumferences in case the loop defined by the ridge lie on a plane perpendicular to a rotation axis of the roller, or may be elliptical if it lies on a plane tilted with respect to a rotation axis of the roller.

Preferably, the ridges are parallel one to the other.

The ridges may be formed in the whole external surface of the first roller or only in a part thereof.

The ridges may have a constant pitch value.

Along their elongation on the roller surface, the circumferential ridges are interrupted by one or more gaps. Preferably, the ridges have a constant amplitude along their circumferential extension, and even more preferably this constant amplitude is the same for all ridges in a roller, with the exception of one or more gaps where the amplitude of the ridges changes. The gap is a portion of the ridge which extends circumferentially for a given angle, preferably a "small" angle compared to the total extension of the ridge equal to 360°, in which an amplitude variation takes place. The angle of the gap is the angle formed between two radii of the roller joining the two ends of the gap with the rotation axis of the roller. For example, the amplitude of the ridge in the gap may be smaller than the amplitude of the ridge along the remaining of its circumferential extension. A smaller amplitude may also mean that within the gap the ridge is flat, that is, within the gap there is no ridge at all. For example, the surface of the roller within the gap has substantially the same radial distance from the center of the roller (rotation axis) as in between two adjacent ridges. Alternatively, the radial distance in the gap is even smaller than between the ridges, so that—in the gap—the surface of the roller is substantially "concave". Therefore, each ridge, when it enters into contact with the sheet of material passing through the first and second roller, creates two different crimping patterns onto the sheet itself. The ridge on the first roller forms a first crimping where the ridge has its standard amplitude, and a second—different—crimping, where there is the gap and the ridge has a different amplitude. For example, in case a smaller or zero or "negative" amplitude of the ridge is present within the gap, the first roller creates on the sheet of material areas of uncrimped or less crimped material during the crimping process corresponding to the location of the gaps.

The final crimping of the sheet, that is, the final pattern of corrugations formed in the sheet depends on the ridges formed in both the first and the second roller. The combination of the crimping action of the ridges of the first and of the second roller creates the corrugations into the sheet of material passing between them.

Areas with uncrimped material in the sheet can be achieved by gaps having a smooth surface on both of the rollers or by gaps having a concave surface on both the rollers.

The sheet of material defines a first and a second surface, or first and second side, opposite to each other. The pattern generated by the rollers on one side of the sheet may be different from the pattern generated on the opposing side of the sheet.

For example, the second roller of the pair may have any possible ridges' pattern or no ridges at all. Therefore, different configurations, detailed below, may arise.

The corrugations on the first roller surface produce effects in the sheet after crimping which are compared to each other in the following paragraphs. In this comparison, "lowest", "lower", "high", "highest" tensile strength are relative to each other and to the sheet tensile strength before crimping, with "highest tensile strength" being equal to the tensile strength of the sheet before crimping.

In the following, with "conventional roller" a roller including ridges having substantially uniform amplitude throughout their circumferential extension is indicated. The ridges thus have substantially no gaps and are "conventionally" used according to the prior art to crimp sheets of material.

Further, the interruption gaps formed in the plurality of ridges are substantially "aligned", that is, they are angularly positioned so that they form bands of gaps running along the surface of the roller. Preferably, all gaps have the same angular dimension. A "band" is therefore the pattern defined by the union of the plurality of gaps formed in the plurality of ridges of the first roller.

Crimping the sheet between two conventional rollers having circumferential ridges creates respective crimped areas on both sides of the sheet in the usual manner according to the prior art. In this situation, shredding can occur. The tensile strength of the crimped sheet has the lowest value in the list of configuration herein disclosed.

Crimping the sheet between the second rollers having a conventional crimp pattern with circumferential ridges without "gaps" and the first roller having areas with interruption bands as detailed above according to the invention, where within the bands the ridges have a smaller amplitude than in the remaining of their circumferential extension, results in a sheet with crimping on both sides, however with less crimping on one side in those areas corresponding to the bands. Less shredding occurrence with a low tensile strength, but higher with respect to the situation above described of crimping between two conventional rollers may be achieved. Crimping the sheet between the second rollers having a conventional crimp pattern with circumferential ridges and the first roller having ridges including interruption bands with uncrimped, smooth areas (that is, the amplitude of the ridges is zero) results in a sheet with crimping on one side of the sheet only in those areas corresponding to the bands, while standard corrugations are produced elsewhere. Possibly, there is no shredding occurrence and a high tensile strength may be achieved.

Crimping the sheet between the second rollers having a conventional crimp pattern with circumferential ridges and the first roller having ridges including interruption bands with uncrimped, concave areas results in a sheet with no crimping on either side of the sheet in the areas corresponding to the bands in the first roller, due to the fact that, although the second roller there are ridges, there is no contact of the ridges surfaces onto the sheets, due to the free space left by the concave portions. Indeed, due to the space available, the sheet is not compressed. Possibly, in such case, there is no shredding occurrence and the highest tensile strength among all configurations described up to now may be achieved. The resistance to draw can be impacted.

Crimping the sheet between two rollers having both ridges with interruption bands within which ridges are present with a smaller amplitude than in the remaining ridge extension results in a sheet with light crimping on both sides in those areas produced by the bands of the rollers facing the sheet, and standard crimping elsewhere. In this configuration, there is possibly less or no shredding occurrence and a high tensile strength may be achieved.

Crimping the sheet between a first roller having ridges with interruption bands within which ridges are present with a smaller amplitude than in the remaining ridge extension and a second roller with ridges having uncrimped, that is smooth, interruption bands, results in a sheet with light crimping on one side in those areas produced by the less crimped or uncrimped bands of the rollers facing the sheet. In this configuration, there is possibly less or no shredding occurrence and the highest tensile strength may be achieved. The resistance to draw can be impacted.

Crimping the sheet between a roller having ridges with interruption bands with less crimped pattern and a roller having ridges with interruption bands having a concave surface, results in a sheet with no crimping in those areas produced by the concave bands areas of the roller facing the sheet. In this configuration, there is possibly less or no shredding occurrence and the highest tensile strength may be achieved. The resistance to draw can be impacted.

Crimping the sheet between two rollers having ridges with interruption bands with uncrimped pattern, either concave or smooth surface, results in a sheet with no crimping in those areas produced by the uncrimped, concave or smooth areas of the rollers facing each other. In this configuration, there is possibly less or no shredding occurrence and the highest tensile strength may be achieved. The resistance to draw can be impacted.

The surfaces of the rollers may be made of hard material such as steel.

Patterned areas may be made by using softer material, such as rubber and the like. Such areas of softer material may cover the entire surface of the roller or be combined on the same roller surface with harder material areas. Using softer material on the surface yields less engraved crimping pattern on the sheet and helps spreading mechanical pressure of the crimping process which can help to prevent damage on material prone to shredding, on material with low tensile strength or when using high processing speed.

The two rollers of the pair may be realized in different materials, for example one of the rollers may be realized with a hard surface and the other one in a softer surface.

Each band in the first roller, called also interruption band, defines a given direction. Said given direction is in particular angled with respect to an axis parallel to the first rotational axis of the roller. In other words, considering the tangent to the band in each point as the direction defined by the band itself, and considering an axis parallel to the first rotational axis and incident to the above defined tangent, the angle formed between these two—direction and axis—is different from about 0°, about 180° or about 90°, that is, the given direction and the axis are neither parallel nor perpendicular. A preferred angle between the axis and the given direction is in the range of about 2° to about 25°, preferably in the range of about 3° to about 24°, preferable in the range of about 13° 20'±10°.

This band on the roller may have a constant direction in all its points, so that the angle is constant, that is, the tangent to the band and the axis always form a constant angle, or the angle may change, always within the preferred range.

Preferably, the band is a portion of a helix. The angle is therefore defined as a helix angle, which can be found by unraveling the helix from the roller, representing the section as a right triangle, and calculating the angle that is formed.

The helix angle can be expressed in this case as:

$$\text{Helix angle}=\arctan(2\pi r/l)$$

Where r is the radius of the roller in the band, and I is the lead of the helix formed by the band (lead is the axial advance of a helix during one complete turn (360°) around the roller).

This interruption band forms a corresponding "angled" band on the crimped sheet. Having a band of differently crimped pattern, such as uncrimped or less crimped material, parallel to the rotation axis, which in practical processes is also the axis of the rod formed at the end of the process, makes it difficult to compress the sheet material into a rod and may have a negative impact on the resistance to draw. The angled band results in a helical arrangement of the interruption band along the longitudinal extension of the first roller crossing the circumferential ridges and being neither parallel nor perpendicular to the rotation axis of the first roller. Having a band of differently crimped material parallel to the rotation axis, which in practical processes is also the axis of a rod formed using the crimped sheet, results in a differently crimped material perpendicular to the longitudinal axis of the rod which makes it difficult to compress the material into a rod and may have a negative impact on the resistance to draw. A helical interruption band is advantageous for the tensile properties of the sheet or web when rods from the crimped sheet or web are formed.

The angle included within the claimed range allows to obtain an optimal resistance to draw because it may allow to have an optimal compromise between the compression strength needed and the formation of channels in the rod through which air is drawn.

The areas having a differently crimped pattern produced on the sheet of material by the apparatus of the invention, such as areas in which there is uncrimped or less crimped material, hold or anchor the other crimped parts of the sheet, including the parts that otherwise could or would be shredded when classical or conventional rollers used for crimping were employed.

Such undesired shredded parts may, when the sheet is gathered and compressed as rod or stick and inserted in the smoking article, travel inside the aerosol generating article. This problem is known in the art as the "fly out" effect, which is disturbing the users smoking experience. The patterns formed in the sheet with the apparatus according to the invention, including two different type of crimping, the crimping formed by the ridges outside the bands and the crimping (or no crimping) formed by the gaps, may allow to maintain a good tensile strength and reduced fly-out parts. Therefore, an increased consistency in the product may be achieved. In particular, the resistance against fly-out can be improved by at least about 30 percent, preferably by at least about 40 percent, more preferably by about 50 percent.

Advantageously, the amplitude of the ridge within the interruption gap is smaller than the ridge amplitude in the remaining circumferential extension of the ridge. The amplitude of the ridge in the gap is preferably "smaller", which also include an amplitude equal to zero or a negative amplitude (no ridge in the gap or a concave surface), than the amplitude of the ridge outside the gap. In this way, a no crimped portion or a less crimped portion can be formed on a sheet of material when in contact with the interruption gap of the roller. The remaining of the roller, that is, the remaining of the roller where no gap is present, forms a standard crimping pattern on the sheet.

Preferably, a distance between the first roller axis and a surface of the first roller in the interruption gap and a distance between the first roller axis and the surface of the first roller between two adjacent ridges are substantially identical. That is, the gap defines a "flat" smooth surface on the first roller. The interruption gap forms a less crimped or uncrimped surface on the processed sheet.

Preferably, a distance between the first roller axis and a surface of the first roller in the interruption gap is smaller than a distance between the first roller axis and the surface of the roller first between two adjacent ridges. That is, the gap defines a "concave" surface on the roller. The interruption gap forms a substantially uncrimped surface on the processed sheet.

Preferably, each of the plurality of ridges is interrupted for the same interruption angle along the circumferential extension. Favorably, the width of the gap is the same for each of the circumferential ridges so that a regular pattern can be formed on a sheet.

Optionally, the dimensions and geometries of the crimping areas with circumferential ridge- and trough pattern and the interruption bands may vary on the same roller.

Favorably, in interruption band formed by the plurality of the interruption gaps, a second plurality of ridges is formed, circumferentially extending parallel to the first plurality for the interruption angle and positioned offset from the first plurality of ridges. A different crimping in the sheet within the created band could be formed by "portion of ridges" formed within the interruption gaps in the rollers, portion of ridges which may for example extend for an angle equal to the angle spanned by the interruption gap. These ridges portions may have the same form or amplitude than the circumferential ridges in the roller, with the exception of the length of the extension, but are offset with respect to the same. Therefore, for example, within the band which determines a different crimping on the sheet, a plurality of portions of ridges, parallel to each other, are formed.

Advantageously, the roller includes a plurality of interruption bands. This allows for crimping sheets or webs of various widths with reproducible characteristics.

Preferably, said plurality of interruption bands extends at a constant distance from each other onto a surface of the first roller. Number of interruption bands and distance between the interruptions bands can be adjusted as needed and allow for a homogeneous pattern on the sheet or web treated by the apparatus. Preferably, the distance between bands is adjusted and depends on the length of the rods formed gathering the crimped sheet.

According to second aspect, the invention provides a method for crimping a sheet of material by feeding a substantially continuous sheet of material to a set of crimping rollers in a transport direction, the set of rollers comprising a first roller and a second roller, at least one of the first or second roller including a first non-uniform plurality of ridges across at least a portion of its width; and by crimping the substantially continuous sheet of material to form the crimped sheet by feeding the substantially continuous sheet between the first and second rollers in the transport direction of the sheet such that the corrugations of the first or second rollers apply a plurality of crimp corrugations to the substantially continuous sheet, the crimp corrugations having a first crimp pattern for a first portion and a second pattern for a second portion, the crimp corrugations forming a plurality of bands onto the crimped sheet, each band alternatively including the first or the second crimp pattern, the bands defining a direction of extension, and said direction of extension forms an angle comprised between about 2° to about 25° with an axis perpendicular to the transport direction.

Advantages of this second aspect have been already detailed with reference to the first aspect and are not repeated herewith.

Preferably, the ratio between the first and second portion is comprised between about 0.125 and about 1.

The ratio between the portions is a ratio between the areas of the portions. Preferably such ratio is comprised between about 0.125 and about 1, more preferably between about 0.4 and about 0.7, more preferably between about 0.4 and about 0.6. More preferably, the ratio is of about 0.5. As mentioned, there could be many bands in the rollers, so that the first portion and the second portions are formed by a plurality of separated area. The following data are given for a single first portion and a single second portion, if more portions of the first or second type are present, the same numbers are applicable to any couple of them. For example, the first portion is a "less crimped" or "not crimped" portion as defined according to the first aspect and, given a constant width of the sheet, it extends along the longitudinal direction for a length comprised between about 2.5 millimeters and about 12 millimeters, more preferably between about 2.5 millimeters and about 6 millimeters, even more preferably of about 4 millimeters. The second portion is for example a "normally crimped portion" and it extends along the longitudinal direction for a length comprised between about 6 millimeters and about 20 millimeters, more preferably between about 6 millimeters and about 9.5 millimeters, more preferably of about 8 millimeters.

Preferably, the ratio is selected such that the second pattern in the sheet as processed into a rod is less than 30% of the total surface, preferably between about 20% to about 25% of the total surface.

Preferably, the sheet of material is a sheet of an aerosol forming substrate. Preferably, the sheet is formed in a material including a plant. More preferably, the sheet includes a plant material containing alkaloids. Even more preferably, the sheet includes tobacco. Even more preferably, the sheet is a homogenized tobacco sheet.

Advantageously, the first or the second portion includes bands extending from one lateral side to the other of the crimped sheet. Using this configuration, the tensile strength can be maintained or even improved within the whole area of the sheet.

Advantageously the method includes forming a plurality of parallel crimped bands on the crimped sheet, each band alternatively including the first or the second crimp pattern. The crimp patterns can be selected according to the properties of the material of the sheet to be crimped, such as resistance to compression, elasticity and the like, as well as other factors such as speed at which the sheet is expected to be pressed by the rollers, pressure exerted by the rollers and the like, and the desired effect of crimping to be achieved. Advantageously the first crimp pattern is a smooth pattern which results in an uncrimped area in the sheet.

Advantageously the method includes gathering the crimped sheet of material, and forming a rod using the crimped sheet of material. The crimped sheet of material is preferably used to form rods to be used in aerosol generating articles. In order to be used for such function, the crimped sheet needs to be folded or compressed so that a substantially tubular shape is formed.

More preferably, the method further include cutting the continuous rod into a plurality of rod-shaped components, each rod-shaped component having a gathered crimped sheet formed from a cut portion of the crimped sheet, the crimp corrugations of the crimped sheet defining a plurality of channels in the rod-shaped component. The tensile strength of the material of the crimped sheet is maintained or improved compared to conventionally crimped sheets as well as shredding is reduced or avoided.

Even more preferably, the continuous rod is cut in a plurality of rod shaped articles having a length substantially equal to a distance between two parallel differently crimped bands. If the distance between the two differently crimped bands, such as uncrimped or less crimped bands, in the rod is less than the rod length, overlap of differently crimped bands can occur in the rod which causes a reduction in the resistance to draw thus hugely degrading the properties of the rod. If the distance between the two differently crimped bands is larger than the rod length, rod areas occur without differently crimped bands thus causing increased undesired fly-out effects.

Having a distance between the two bands of the same size as the rod length avoids said problems, as this results in only one differently crimped band, the band being continuous or not continuous. In particular, the distance between the bands can be adjusted by a prober angle of inclination of the interruption bands on the rollers.

According to a third aspect, the invention provides a crimped sheet for an aerosol generating article, the crimped sheet having a longitudinal direction and including a plurality of bands, each band including crimp corrugations of a first or of a second pattern, two adjacent bands having crimp corrugations having different patterns, each band defining a direction of extension which forms an angle comprised between about 2° to about 25° with an axis perpendicular to the longitudinal direction of the sheet.

This crimped sheet can be folded and may be used in an aerosol generating article obtaining a proper resistance to draw value. Advantageously, the bands of the crimped sheet are inclined with respect to a longitudinal direction of the crimped sheet. An angle of inclination is preferably different from about 0° or about 90°. Having a band of uncrimped material parallel to the rotation axis, which in practical processes is also the axis of the rod, result in uncrimped material perpendicular to the longitudinal axis of the rod which makes it difficult to compress the material into a rod and will have a negative impact on the resistance to draw. A preferred angle is in the range of about 2° to about 25°, preferably in the range of about 3° to about 24°, preferable in the range of about 13° 20'±10°.

Preferably, the ratio between bands having crimp corrugations of a first pattern and bands having crimp corrugation having a second pattern is comprised between about 0.125 and about 1.

Preferably, the ratio is selected such that the bands having the first pattern in the sheet as processed into a rod are less than about 30 percent of the total surface of the sheet, preferably between about 20 percent to about 25 percent.

The ratio between the bands is a ratio between the areas of the bands. Preferably, the ratio is comprised between about 0.125 and about 1, more preferably between about 0.4 and about 0.7, more preferably between about 0.4 and about 0.6. More preferably, the ratio is of about 0.5. As mentioned, there could be many bands in the rollers, so that there are many bands having the first pattern and many bands having the second pattern. The following data are given for a single bands of the first pattern and a single band having the second pattern, if more bands of the first or second type are present, the same numbers are applicable to any couple of them. For example, the bands having the first pattern are "less crimped" or "not crimped" bands as defined according to the first aspect and, given a constant width of the sheet, each of them extends along the longitudinal direction for a length comprised between about 2.5 millimeters and about 12 millimeters, more preferably between about 2.5 millimeters and about 6 millimeters, even more preferably of about 4 millimeters. The bands having the second pattern are for example a "normally crimped" bands and each of them extends along the longitudinal direction for a length comprised between about 6 millimeters and about 20 millimeters, more preferably between about 6 millimeters and about 9.5 millimeters, more preferably of about 8 millimeters.

The sheet having crimped area according to two different patterns displays the advantages already described with reference to the first or second aspect of the invention and are not repeated herewith.

Advantageously the crimp corrugations of the second pattern are offset with respect to the crimp corrugation of the first pattern. Thus two adjacent bands are provided with offset corrugations.

Advantageously, the crimp corrugations of the first pattern have a smaller amplitude than the crimp corrugations of the second pattern. More preferably, the first pattern is smooth. Smooth has the meaning of being is free from corrugations. It is preferred that the "smaller" bands have either an uncrimped surface or a "less crimped" one, where with "less crimped" includes corrugations having a smaller amplitude, or less corrugations per area unit.

Preferably, the crimped sheet defines a first and a second lateral edge, opposed to each other, and the bands extend from the first lateral edge to the opposite lateral edge.

According to fourth aspect, the invention relates to a rod for an aerosol generating article, said rod including a portion of the crimped sheet realized as described above according to the third aspect or manufactured by the method as described in the second aspect.

The rod includes sheet material having a good tensile strength and providing anchoring areas for the crimped material, thus avoiding shredding and subsequently fly-out effects as well as a favourable resistance to draw.

Advantageously, said rod has a given length, the distance between two adjacent bands in the crimped sheet being substantially equal to the rod length. In particular, the distance between the adjacent bands can be adjusted by a proper angle of inclination of the interruption bands in the rollers.

The invention will be further described, by way of example only, with reference to the accompanying drawings in which.

Figure 1:
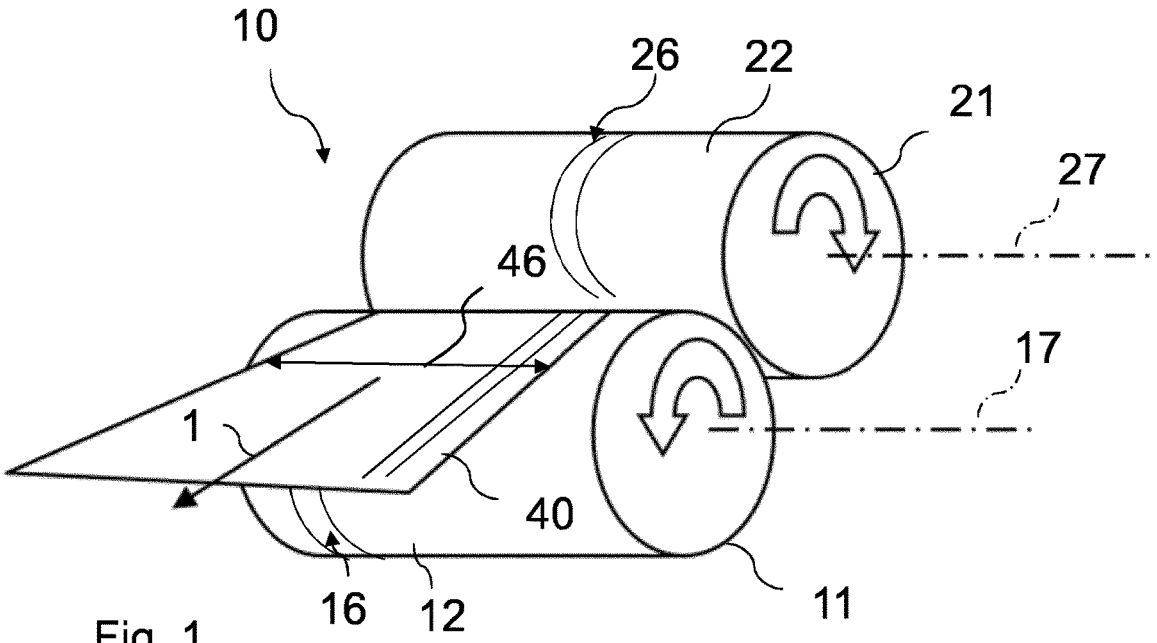
FIG. 1 shows an isometric view of an apparatus having two rollers between which a sheet of material is treated according to the invention.

With initial reference to FIG. 1, the Figure shows an isometric view of an apparatus 10 comprising a first and second facing crimping rollers 11, 21 between which a sheet 40 of material having a width 46 is treated according to the invention. The transport direction 1 of the sheet 40 is indicated with an arrow pointing to left forward in the figure.

The first and second facing crimping roller 11, 21 define a first and second rotation axis 17, 27, respectively. The surfaces of the rollers 11, 21 are provided with corrugations, where ridge- and trough pattern 16, 26 are indicated by two circumferential lines on the surface of each roller 11, 21.

One or both rollers 11, 21 have uncrimped and/or less corrugated areas and are mutually arranged so that such areas on one roller 11 or 21 is facing other such areas or usual ridge- and trough pattern 16, 26 on the other roller 21 or 11 during the crimping process.

The corrugations of the first and second rollers 11, 21 at least partially mesh. The corrugations of one or both of the rollers 11, 21 are symmetrical or asymmetrical. The corrugations of the rollers 11, 21 may be substantially aligned, or at least partially offset. The peak of one or more corrugations of the first or second rollers 11, 21 may interleave with the trough of a single corrugation of the other of the first and second rollers 11, 21. Preferably, the corrugations of the first and second rollers 11, 21 interleave such that substantially all of the corrugation troughs of one of the first and second rollers 11, 21 each receive a single corrugation peak of the other of the first and second rollers 11, 21. The surface patterns of both rollers 11, 21 are transmitted to the surfaces of the sheet 40 when pressed between the two rollers 11, 21.

Figure 2:
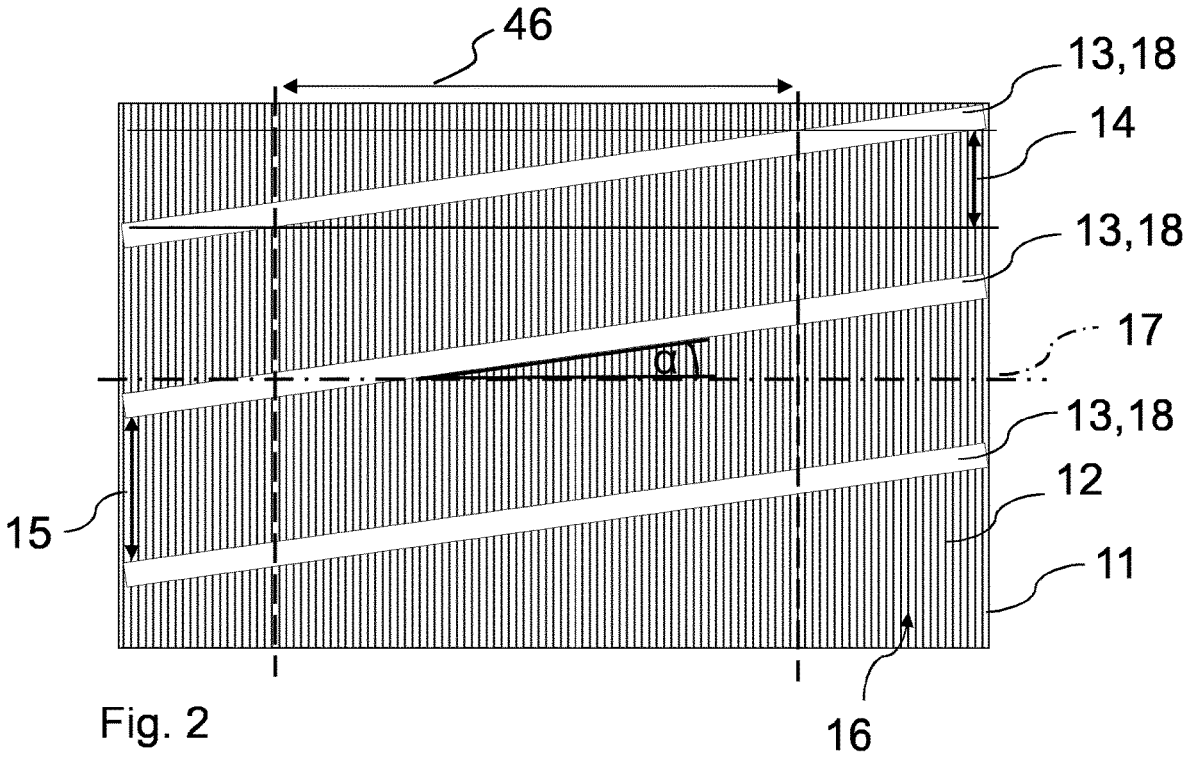
FIG. 2 shows a two-dimensional representation of a surface of a roller having a ridge-and-trough pattern crossed by interruption bands.

As can be seen in FIG. 2, where the first roller 11 is depicted as a two dimensional area for clarity, the surface 12 of the roller 11 has a conventional ridge-and-trough pattern 16 combined with parallel bands 13, also called interruption bands in the following, having a different pattern, in this example a smooth surface 18. The ridge-and-trough pattern 16 is comprised of circumferential ridges, each ridge defining a ridge amplitude. The ridges can be oriented perpendicular to the rotation axis 17 or can be slightly inclined, for example by not more than about 10°. The ridges are crossed by interruption bands 13.

Generally, the interruption band 13 is corrugated differently than the ridge-and-trough pattern 16. The interruption band 13 may comprise a less corrugated pattern than the ridge-and-trough pattern 16 with a lower ridge amplitude or a smaller number of ridges and troughs, for example a larger pitch value (denoted as "less crimped"). The interruption band 13 may be a concave band where no pressing of the sheet 40 occurs or may have a smooth surface 18 where no corrugation is created by the crimping process (denoted as "uncrimped").

The roller 11 can have combinations of a conventional ridge-and-trough pattern 16 and interruption bands 13 which are less corrugated or uncorrugated. Dimensions and geometries can vary on the same roller 11. Both rollers 11 and 21 can be provided with such interruption bands 13.

The other roller 21 as shown in FIG. 1 may have a conventional crimping surface.

The interruption band 13 is formed by a first plurality of circumferential ridges where each ridge is interrupted by an interruption gap and where for a given interruption angle an amplitude of the ridge differs from the ridge amplitude in the remaining circumferential extension of the ridge. The interruption band 13 is inclined with respect to an axis parallel to the first rotation axis 17 by an angle $\alpha$. The angle $\alpha$ is different from about 0° and from about 90° and it is comprised between about 2° and 25°. In FIG. 2, the angle $\alpha$ is the angle between the band and an axis—still indicated with 17—parallel to the first rotational axis.

The interruption bands 13 are arranged parallel to each other and spaced apart by a constant distance 15. Further, a is constant in the whole band.

Figure 3:
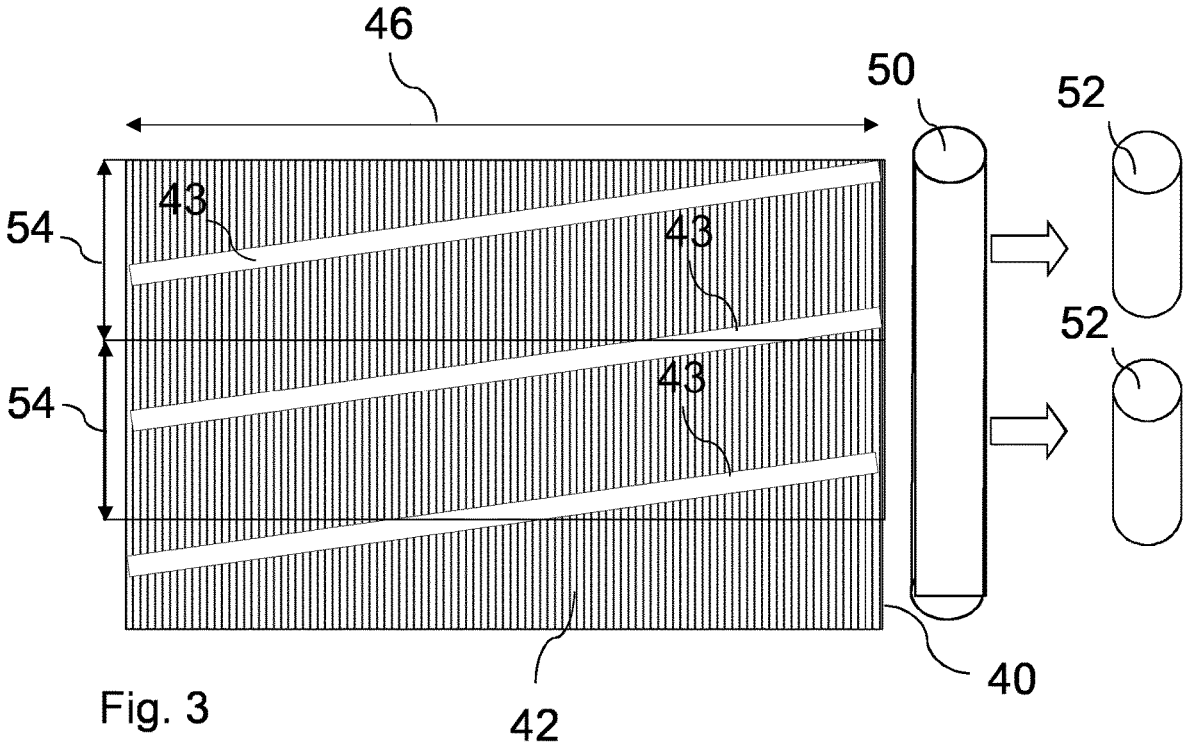
FIG. 3 shows a sheet of material after treatment in the apparatus of FIG. 1 according to the invention.

Preferably, the distance 15 between two interruption bands 13 is less than a length of a rod (FIG. 3). The distance 15 is calculated as the distance along an axis perpendicular to the longitudinal axis 17 of the roller 11 from the end of an interruption band 13 to the start of the next interruption band 13. Preferably, the distance 15 between two bands 13 is constant.

FIG. 3 shows a sheet 40 of material after treatment in the apparatus 1 of FIG. 1 according to the invention. The surface of the sheet 40 shows corrugations which substantially reproduce the corrugations on the surface of roller 11 in FIG. 2, for instance. The interruption bands 13 (FIG. 1) are reproduced as bands 43 on the sheet 40 which are crimped differently as compared to the corrugations 42 which reproduce the ridge-and-trough pattern 16 of the rollers in FIG. 2 outside the interruption bands 13.

The differently crimped bands 43 are, in this example, provided with smooth surfaces. The differently crimped bands 43 are inclined with respect to the direction of the sheet 40 perpendicular to the longitudinal extension by an angle $\alpha$ which is the same angle as the inclination angle $\alpha$ of the interruption bands 13 with respect to the longitudinal axis 17 in the roller in FIG. 2. Angle $\alpha$ is thus the angle between the band and a direction perpendicular to the transport direction indicated with 1 in FIG. 1.

The crimped sheet 40 of material is gathered and formed into a rod shaped component 50. The crimp corrugations of the crimped sheet 40 define a plurality of channels in the rod-shaped component 50. The rod shaped component 50 is then cut into rods 52 having a rod length 54 which is preferably equal to the distance 15 between two differently crimped bands 43.

By way of example, the crimper rollers 11, 21 are about 0.32 meters long with a diameter of 0.21 meters. the width 46 of the sheet is about 0.125 meters±0.05 meters. The angle $\alpha$ is about 13° 20'±10°. The width of the uncrimped areas 43 in the sheet 40 is about 0.0028 meters±0.002 meters which is about 20-25% of the rod length. The distance between two uncrimped areas 43 is equal to the rod length 54, while the rod length 54 is about 0.012 meters±0.005 meters.

With such values, tests on a tobacco cast leaves material have shown a sharp decrease in the fly-out effect as well as a higher tensile strength as compared to conventionally crimped material. The resistance of the improved sheet 40 against fly-out can be increased by about 50%. This was found in a fly-out test set-up which was done by fixing several rods radially on a motorized disc that will accelerate up to about 650 turns per second. These rods, usually part of aerosol generating articles, include a tobacco rod at their distal part. Outside the peripheral of the disc, untouched by the rods at start, a laser detector is emitting a laser beam perpendicular to the surface of the disc. This laser detector sends a signal as soon as its beam is blocked by a part of the tobacco rod pushed away from the fixed rods by the centrifugal force of the rotation of the motorized disc. The moment this signal is emitted indicate the end of the test and give a value of the resistance of the tobacco rod to "fly out" effect.

Figure 4:
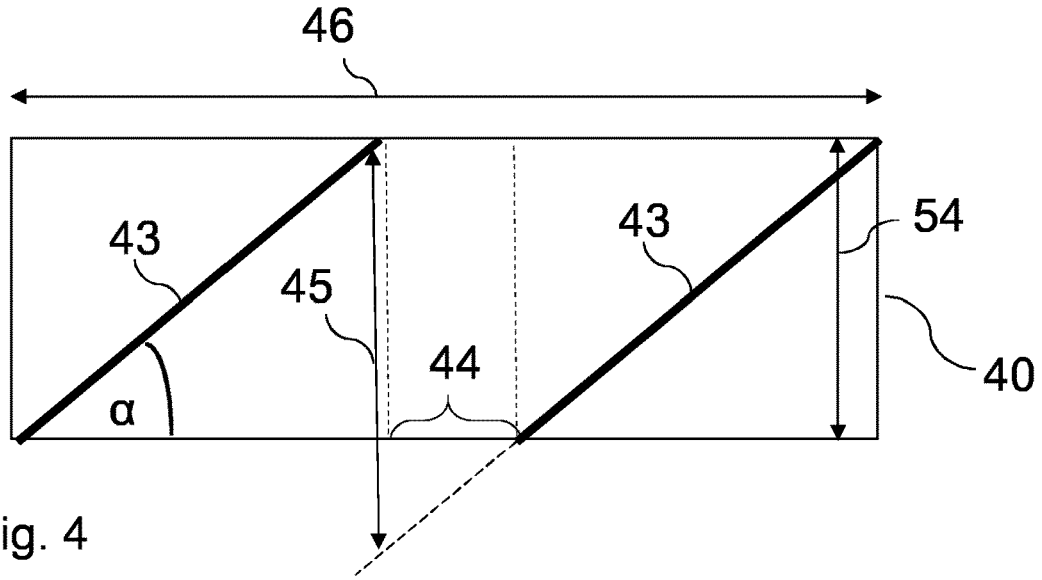
FIG. 4 shows a schematic top view of a treated sheet having areas without a differently crimped band according to the invention.
Figure 5:
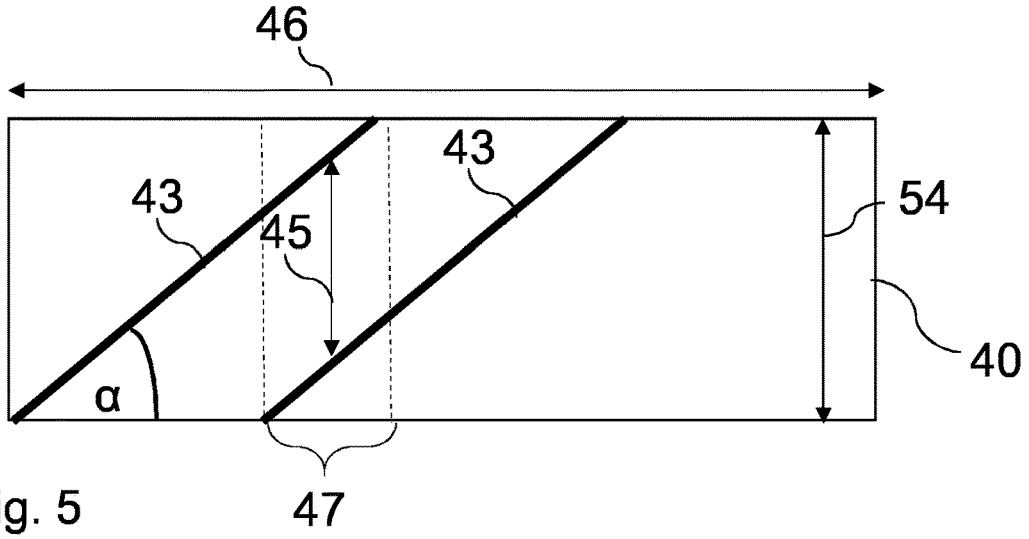
FIG. 5 shows a schematic top view of a treated sheet having areas with overlapping differently crimped bands according to the invention.
Figure 6:
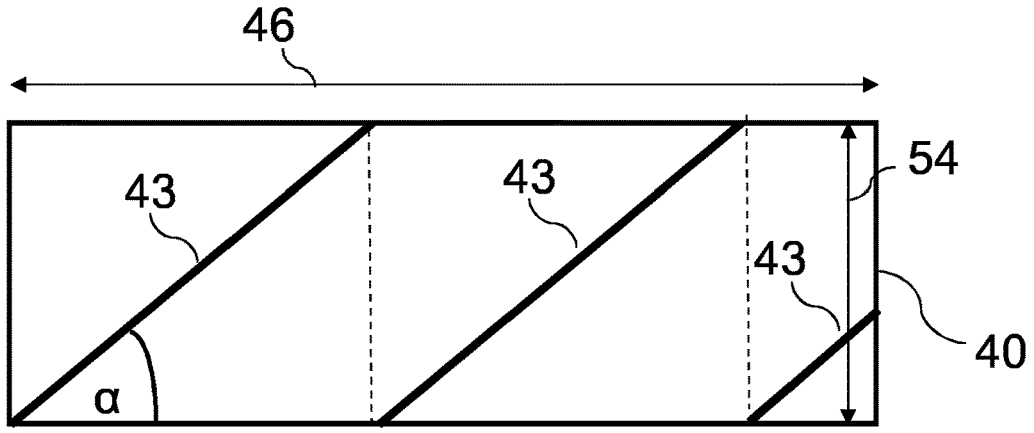
FIG. 6 shows a schematic top view of a treated sheet of material with optimized arrangement of differently crimped bands according to the invention.

Referring now to FIGS. 4-6, which depict schematic top views of crimped sheets 40, the figs. show the influence of comprising different distances of the uncrimped or less crimped bands 43 in the sheets 40.

As can be seen in FIG. 4, when the distance 45 between two uncrimped bands 43 is more than the rod length 54, areas 44 are created in the rod without an uncrimped band where "fly out" effect may occur.

FIG. 5 shows that when the distance 45 between two uncrimped bands 43 is smaller than the rod length 54, there are areas 47 where there is, along the longitudinal axis of the rod, more than one uncrimped band 43. When the sheet 40 is compressed into a rod, this can create an unfavourable distribution of the sheet 40 that could reduce the resistance to draw below a desired level.

FIG. 6 shows a preferred arrangement where the uncrimped bands 43 in the sheet 40 are such that the distance 45 between the uncrimped bands 43 is equal to the rod length 54, which favourably prevents the problems indicated in FIGS. 4 and 5.

Figure 7:
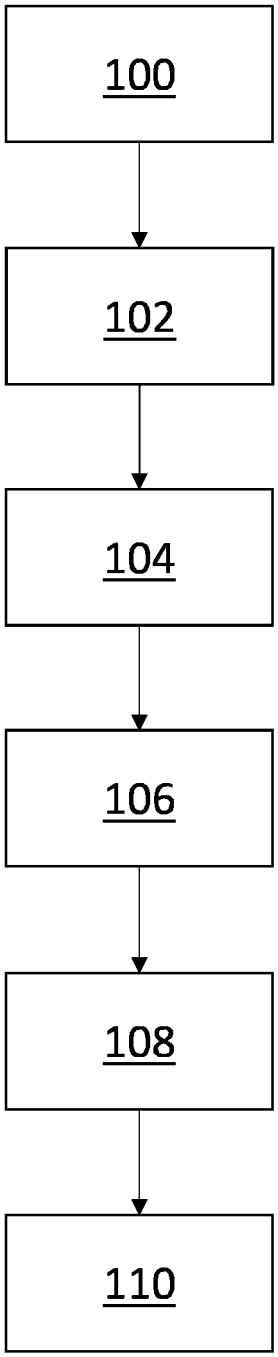
FIG. 7 shows a flow chart of a method for crimping a sheet of material according to the invention.

FIG. 7 shows a flow chart of a method for crimping a sheet of material according to the invention.

In a first step 100 a substantially continuous sheet of material is fed to a set of crimping rollers in a transport direction. The set of rollers comprise a first roller and a second roller, where at least one of the first or second roller includes a first non-uniform plurality of ridges across at least a portion of its width.

In step 102, the substantially continuous sheet of material is crimped to form the crimped sheet by feeding the substantially continuous sheet between the first and second rollers in the transport direction of the sheet such that the corrugations of the first or second rollers apply a plurality crimp corrugations to the substantially continuous sheet. The first or the second portion includes bands extending from one lateral side to the other of the crimped sheet.

In step 104 a plurality of parallel crimped bands are formed onto the crimped sheet, each band alternatively including a first or the second crimp pattern. Preferably, the second crimp pattern is a smooth pattern.

In step 106, the crimped sheet of material is gathered and a rod is formed using the crimped sheet of material in step 108.

In step 108 the continuous rod is cut into a plurality of rod-shaped components, each rod-shaped component having a gathered crimped sheet formed from a cut portion of the crimped sheet, the crimp corrugations of the crimped sheet defining a plurality of channels in the rod-shaped component.

Finally, in step 110 the continuous rod is cut in a plurality of rod shaped articles having a length substantially equal to a distance between two parallel differently crimped bands.

The invention claimed is:

1. A method for crimping a sheet of material, the method comprising:

feeding a substantially continuous sheet of material to a set of crimping rollers in a transport direction, the set of rollers comprising a first roller and a second roller, at least one of the first or second roller including a first non-uniform plurality of ridges across at least a portion of its width;

crimping the substantially continuous sheet of material to form the crimped sheet by feeding the substantially continuous sheet between the first and second rollers in the transport direction of the sheet such that the corrugations of the first or second rollers apply a plurality of crimp corrugations to the substantially continuous sheet, the crimp corrugations having a first crimp pattern for a first portion and a second pattern for a second portion;

the crimp corrugations forming a plurality of bands onto the crimped sheet, each band alternatively including the first or the second crimp pattern, the bands defining a direction of extension, and said direction of extension forms an angle comprised between about 2° to about 25° with an axis perpendicular to the transport direction.

2. The method according to any of claim 1, including:

gathering the crimped sheet of material, and forming a rod using the crimped sheet of material.

3. The method according to claim 2, including:

cutting the continuous rod into a plurality of rod-shaped components, each rod-shaped component having a gathered crimped sheet formed from a cut portion of the crimped sheet, the crimp corrugations of the crimped sheet defining a plurality of channels in the rod-shaped component.

* * * * *